US008845260B2

(12) United States Patent
Gerber

(10) Patent No.: US 8,845,260 B2
(45) Date of Patent: Sep. 30, 2014

(54) APPARATUS AND METHOD FOR HANDLING PIPE

(75) Inventor: Andrew Virgil Gerber, Langdon (CA)

(73) Assignee: Markwater Handling Systems Ltd., Calgary (CA)

( * ) Notice: Subject to any disclaimer, the term of this patent is extended or adjusted under 35 U.S.C. 154(b) by 265 days.

(21) Appl. No.: 13/387,363

(22) PCT Filed: Jul. 29, 2010

(86) PCT No.: PCT/CA2010/001187
§ 371 (c)(1),
(2), (4) Date: Jan. 26, 2012

(87) PCT Pub. No.: WO2011/011888
PCT Pub. Date: Feb. 3, 2011

(65) Prior Publication Data

US 2012/0118639 A1 May 17, 2012

Related U.S. Application Data

(60) Provisional application No. 61/229,630, filed on Jul. 29, 2009.

(51) Int. Cl.
*E21B 19/00* (2006.01)
*E21B 19/15* (2006.01)

(52) U.S. Cl.
CPC ..... *E21B 19/15* (2013.01)
USPC ..... 414/22.54; 414/22.62; 414/745.7

(58) Field of Classification Search
USPC ..... 414/22.51–22.71, 745.1–746.8, 910, 414/911
See application file for complete search history.

(56) References Cited

U.S. PATENT DOCUMENTS

| | | | | | |
|---|---|---|---|---|---|
| 3,706,347 | A * | 12/1972 | Brown | 175/85 |
| 3,780,883 | A | 12/1973 | Brown | |
| 4,067,453 | A * | 1/1978 | Moller | 414/22.61 |
| 4,371,302 | A * | 2/1983 | Frias et al. | 414/22.61 |
| 4,439,091 | A | 3/1984 | Frias | |
| 4,474,520 | A * | 10/1984 | Buckner et al. | 414/22.61 |
| 4,486,137 | A * | 12/1984 | Buckner | 414/22.61 |
| 4,552,498 | A * | 11/1985 | Dysarz | 414/22.58 |
| 6,994,505 | B2 * | 2/2006 | Hawkins, III | 414/22.54 |
| 2007/0031215 | A1 * | 2/2007 | Belik | 414/22.62 |

FOREIGN PATENT DOCUMENTS

| | | | |
|---|---|---|---|
| CA | 1 167 833 | A1 | 5/1984 |
| CA | 2 115 810 | A1 | 4/1995 |
| CA | 2 396 333 | A1 | 7/2001 |
| CA | 2 551 901 | C | 1/2007 |
| CA | 2 624 363 | A1 | 4/2007 |

OTHER PUBLICATIONS

International Search Report mailed Nov. 12, 2010, issued in corresponding International Application No. PCT/CA2010/001187, filed Jul. 29, 2010, 5 pages.

* cited by examiner

*Primary Examiner* — Gregory Adams
*Assistant Examiner* — Lynn Schwenning
(74) *Attorney, Agent, or Firm* — Christensen O'Connor Johnson Kindness PLLC

(57) ABSTRACT

An apparatus is provided for moving pipe between pipe storage racks and a pipe handler on a pipe deck of a drilling rig. The apparatus is capable of retrieving pipe from tiered stacks of pipe in a pipe rack located behind Samson posts, and moving the pipe up and over the Samson posts onto a pipe stand or pipe handler.

36 Claims, 14 Drawing Sheets

APPARATUS AND METHOD FOR HANDLING PIPE

CROSS REFERENCE TO RELATED APPLICATIONS

This application claims priority of U.S. provisional patent application Ser. No. 61/229,630 filed Jul. 29, 2009 and hereby incorporates the same provisional application by reference herein in its entirety.

TECHNICAL FIELD

The present disclosure is related to the field of oil well operations, in particular, pipe-handling apparatuses used to move pipe up and over Samson posts between pipe racks and pipe-handling devices used to move pipe to and from a drilling rig floor.

BACKGROUND

On drilling rigs, in particular, offshore Jack-Up drilling rigs, drill pipe can be stored in tiered pipe stacks or racks behind stanchions known as "Samson posts" on the cantilever pipe deck. On typical offshore rigs, cranes are utilized to lift singles or bundles of pipe from the pipe racks to a catwalk on a pipe handler or up to the drill floor. This process requires people to work in and around these suspended loads to hook up bundles of pipe. This is a hazardous job where workers are prone to injury.

It is, therefore, desirable to provide an apparatus for moving pipe from a pipe rack up and over the Samson post that is safe, controlled and efficient, and one that is remotely controlled, does not require cranes and does not require a person to touch the pipe as it is being moved.

SUMMARY

In some embodiments, an apparatus is provided for moving pipe from a pipe rack located behind the Samson posts to a pipe handler so that the pipe can be delivered up to the drill floor of drilling rig, or to any other location on the rig. The apparatus can comprise of a carriage slidably disposed on a substantially vertical support beam wherein the carriage can move up and down on the beam. The carriage can further comprise a rotatable arm disposed thereon, the arm further comprising a tine configured to pick up and carry pipe. The tine can move to pick up pipe from any position in the pipe rack by rotating the arm and moving the carriage vertically on the beam. The apparatus can be mounted on the pipe deck beside the Samson posts, or it can be mounted on the pipe handler, that can skid from the pipe rack to a position on the pipe deck that aligns with the well bore.

The arm can comprise a mechanically geared tine that can remain horizontal through the arm's 360 degree rotation about a horizontal axis. By separately driving and controlling the arm's rotation and the carriage's vertical position, a pipe can be picked up and lifted over the Samson post to the other side and then lowered onto a receiving rack. The arm can be sufficiently long that it can pick up pipe from the same height as the mounting base of the vertical support beam and yet lift the pipe clear over the top of the Samson post when the carriage is lifted to its highest position on the beam. The motors used for lifting the carriage or rotating the arm can be adapted or configured for automated or semi-automated control, which can allow for programmed device sequences and indexing positions for different pipe diameters and tier heights in the pipe rack. When combined with programmable logic controller ("PLC") control, precise, repeatable and predictable movement can be achieved in the movement of the pipe and, thus, can achieve a safer work place for personnel. The movement of pipe from the pipe rack to a pipe handler can be achieved entirely mechanically and without personnel having to touch the pipe, and can, thus, greatly increase the safety of moving pipe on the drilling rig.

Broadly stated, in some embodiments, an apparatus for raising pipe from a pipe rack up and over a Samson post to a pipe handler located on a pipe deck of a drilling rig, the apparatus comprising: a substantially vertical beam configured to be positioned adjacent the Samson post; a carriage disposed on the vertical beam, the carriage configured to move up and down the vertical beam; a lift drive assembly configured to move the carriage up and down the vertical beam; an arm rotatably disposed on the carriage, the arm further comprising a tine configured to pick up and carry pipe; and an arm drive assembly configured to rotate the arm.

Broadly stated, in some embodiments, a method is provided for raising pipe from a pipe rack up and over a Samson post to a pipe handler located on a pipe deck of a drilling rig, the method comprising the steps of: providing an apparatus comprising: a substantially vertical beam configured to be positioned adjacent the Samson post on the pipe deck, a carriage disposed on the vertical beam, the carriage configured to move up and down the vertical beam, a lift drive assembly configured to move the carriage up and down the vertical beam, an arm rotatably disposed on the carriage, the arm further comprising a tine configured to pick up and carry pipe, and an arm drive assembly configured to rotate the arm; rotating the arm and moving the carriage on the vertical beam wherein the tine engages and lifts the pipe; and moving the carriage up on the vertical beam and rotating the arm wherein the pipe is carried over the top of the Samson post.

Broadly stated, in some embodiments, a pipe handler is provided for use on a pipe deck on a drilling rig, the pipe handler configured for moving pipe from a pipe rack located behind Samson posts disposed on the pipe deck to a drilling rig floor, the improvement comprising an apparatus for raising pipe from the pipe rack up and over the Samson post to the pipe handler, the apparatus comprising: a substantially vertical beam configured to be disposed on the pipe handler and adjacent to the Samson post when pipe is moved between the pipe rack and the pipe handler; a carriage disposed on the vertical beam, the carriage configured to move up and down the vertical beam; a lift drive assembly configured to move the carriage up and down the vertical beam; an arm rotatably disposed on the carriage, the arm further comprising a tine configured to pick up and carry pipe; and an arm drive assembly configured to rotate the arm.

DETAILED DESCRIPTION OF EMBODIMENTS

Figure 1:
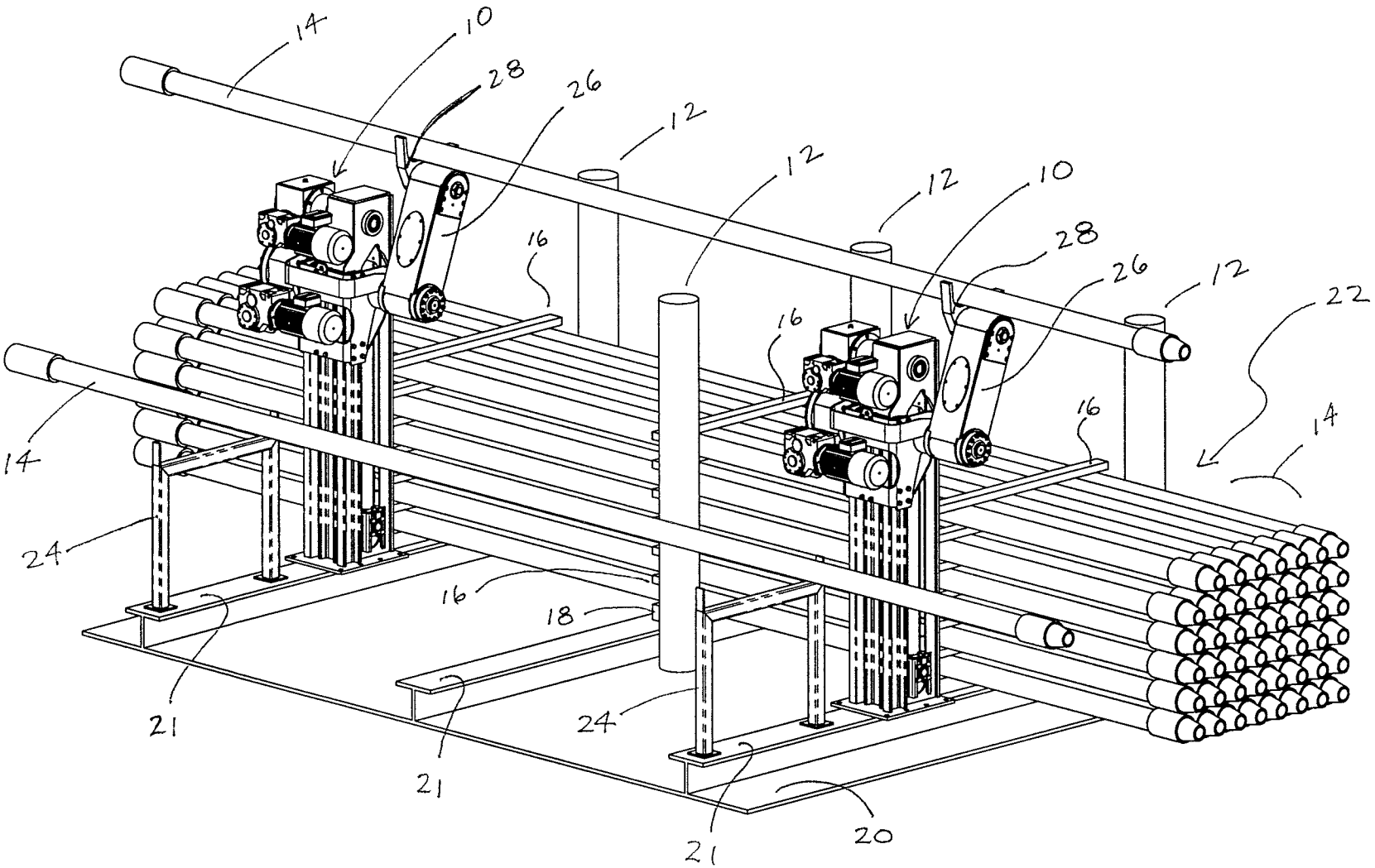
FIG. 1 is a perspective view depicting one embodiment of a pipe-handling apparatus moving a section of pipe from a pipe rack over a "Samson" post onto a pipe stand.

In a broad aspect, a pipe-handling apparatus is provided for moving pipe between a pipe storage rack and a pipe-handling device that moves pipe to and from the drill floor of a drilling rig. For the purposes of this specification, the term "pipe" is understood to include tubular pipe, drill pipe, casing, drill collars and other pipe, as known to those skilled in the art, used in the drilling of wells and the production of substances from said wells. In some embodiments, the apparatus can retrieve pipe from tiered stacks located behind the Samson posts whereby the apparatus can load pipe onto a carrier tine, raise the pipe vertically with respect to the Samson post and swing the pipe over the top of the Samson post where the pipe can be placed on a pipe stand to be loaded onto a pipe-handling device, or directly onto the pipe-handling device. For the purpose of this specification, the terms "Samson post elevator" and "Samson lift" are understood to represent the apparatus described herein and, in particular, apparatus 10 as shown in FIG. 1. In operation, one or more sections of pipe can be loaded onto the pipe-handling device using the Samson post elevator, whereby multiple sections of pipe can be lifted simultaneously up to the drill floor. From this position the pipe can be dispensed from the pipe-handling device to a presentation position and deliver the pipe to the drilling rig floor.

In the reverse, the pipe handler is able to accept and retrieve pipe individually from the drilling rig floor, and store multiple pipe in a single layer across the pipe-handling device, then lower them down to the cantilever deck level where they can be delivered to a pipe rack located behind the Samson posts. Samson post elevators can then be utilized to return the pipe to a tiered stack formation behind the posts. In some embodiments, the Samson post elevators can also form part of the overall pipe-handling device.

Figure 3:
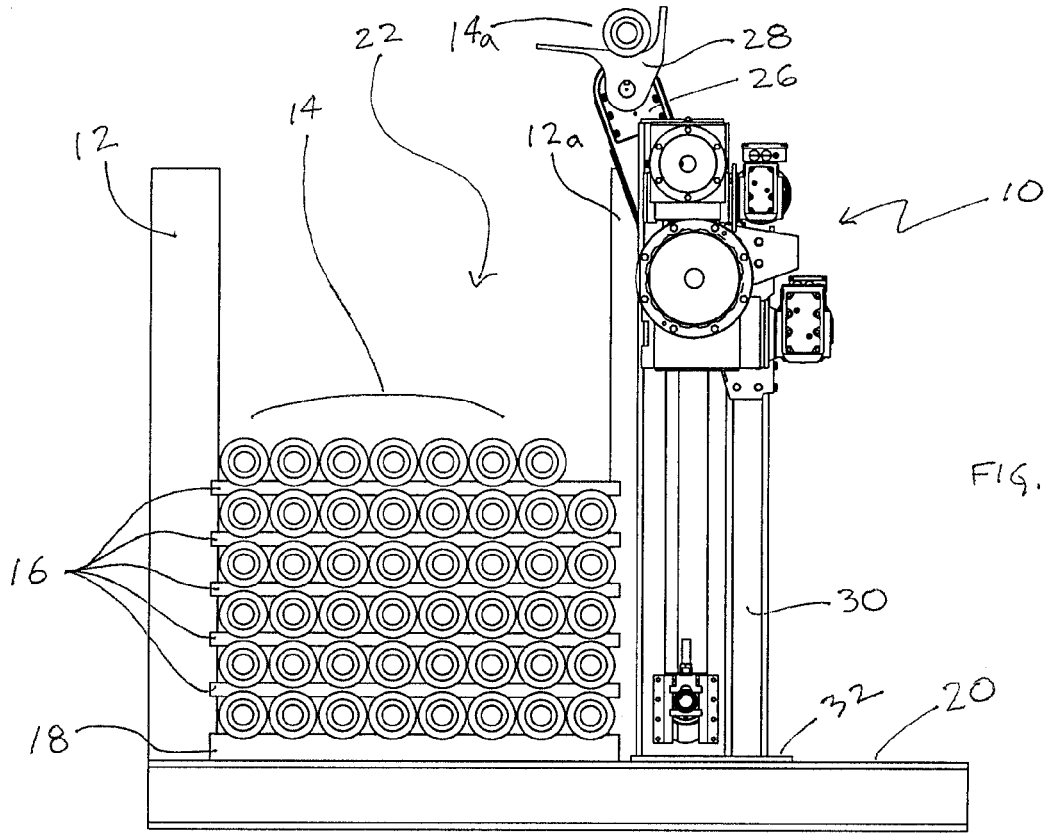
FIG. 3 is an end elevation view depicting the pipe-handling apparatus of FIG. 2 moving the section of pipe over a Samson post.

Referring to FIG. 1, one embodiment of apparatus 10 is shown. In this figure, a plurality of sections of pipe 14 can be placed in pipe rack 22. The first layer of pipe 14 can rest on bottom tier spacer 18 to elevate pipe 14 off of deck beams 21 that form deck 20. Spacers 16 can be used to separate subsequent layers of pipe 14 within pipe rack 22. One or apparatuses 10 can be used move pipe 14 over Samson posts 12 and rest them on pipe stand 24. Apparatus 10 can comprise arm 26 rotatably attached to apparatus 10 at one end, the other end of arm 26 comprising tine 28, which can be configured to pick a section of pipe 14 from storage rack 22 and carry it up and over Samson posts 12. In some embodiments, tine 28 can comprise an L-shaped configuration, as illustrated in FIG. 3, although it is obvious to those skilled in the art that other physical configurations or shapes suitable for picking and holding a section of pipe 14 can be used to form tine 28. As an example, the tine can comprise a shallow-V configuration, as illustrated as tine 102 in FIG. 14.

Figure 2:
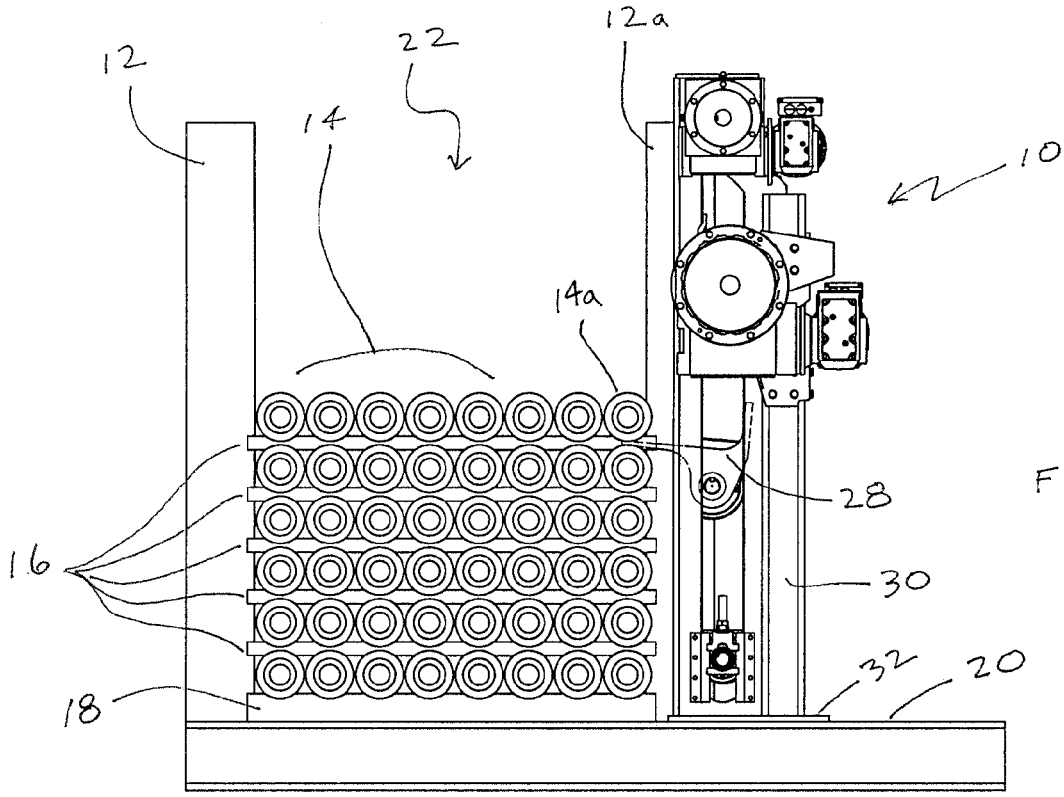
FIG. 2 is an end elevation view depicting the pipe-handling apparatus of FIG. 1 removing a section of pipe from a pipe rack.
Figure 4:
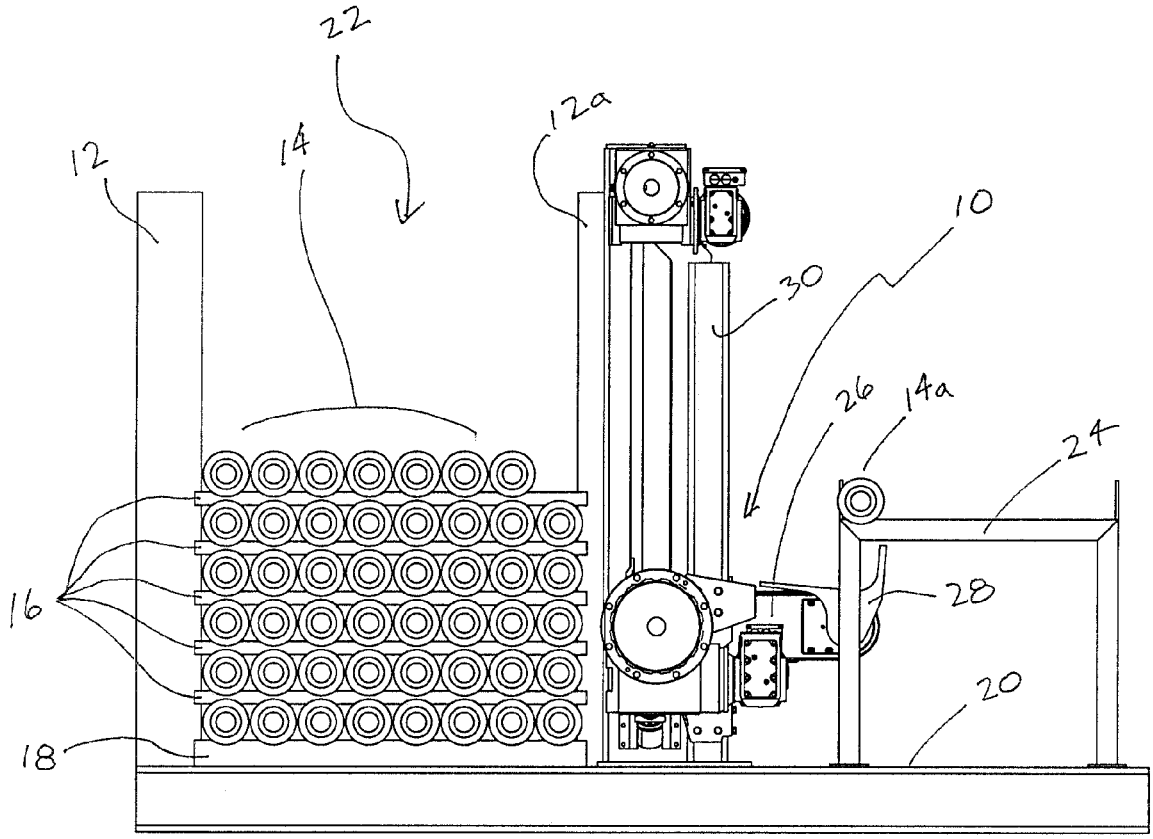
FIG. 4 is an end elevation view depicting the pipe-handling apparatus of FIG. 2 depositing the section of pipe onto a pipe stand.

Referring to FIGS. 2, 3 and 4, apparatus 10 is shown picking, lifting and placing a section of pipe 14 onto pipe stand 24. In FIG. 2, apparatus 10 is shown picking pipe 14*a* by rotating arm 26 and tine 28 underneath said pipe to lift it upwards. In FIG. 3, apparatus 10 is shown lifting pipe 14*a* by moving upwards on guide beam 30, which is secured to deck 20 via base plate 32, and rotating arm 26 clockwise to swing pipe 14*a* over the top of Samson post 12*a*. In FIG. 4, pipe 14*a* is shown lowered onto pipe stand 24, which can be accomplished by apparatus 10 moving downward on guide beam 30 and rotating arm 26 to an approximate 3 o'clock position, as shown in FIG. 4.

Figure 5:
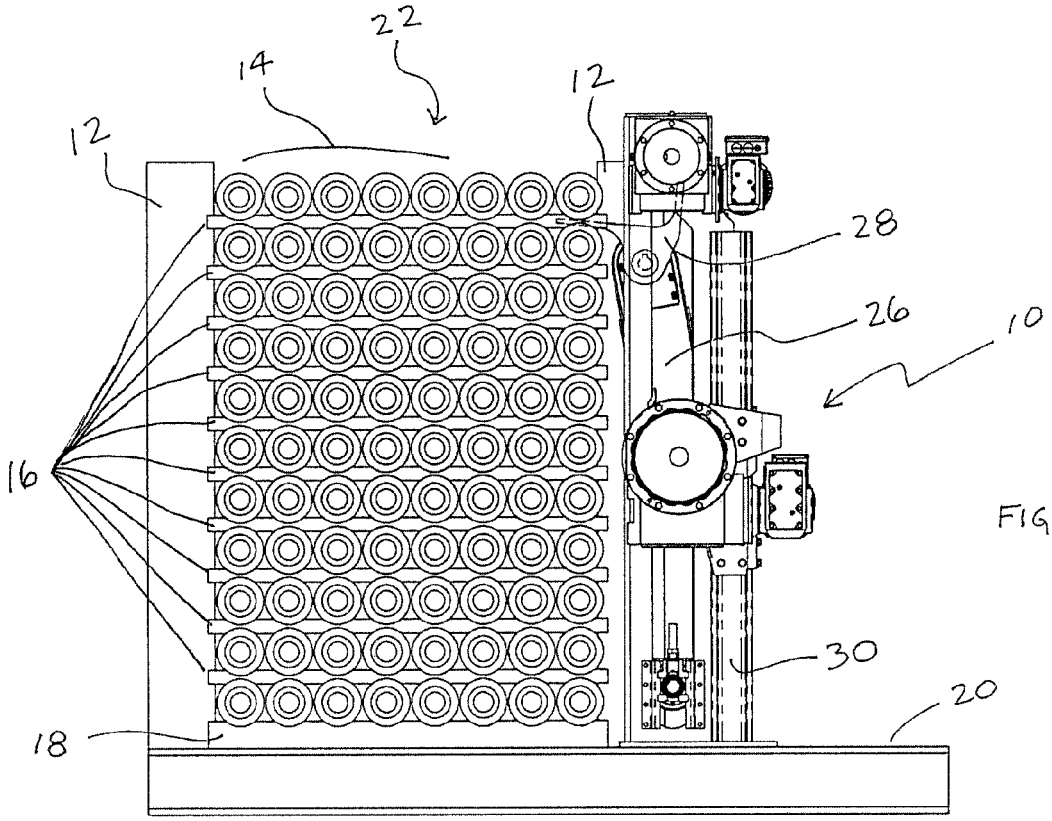
FIG. 5 is an end elevation view depicting the pipe-handling apparatus of FIG. 2 removing a section of pipe from the top tier on a pipe rack.
Figure 6:
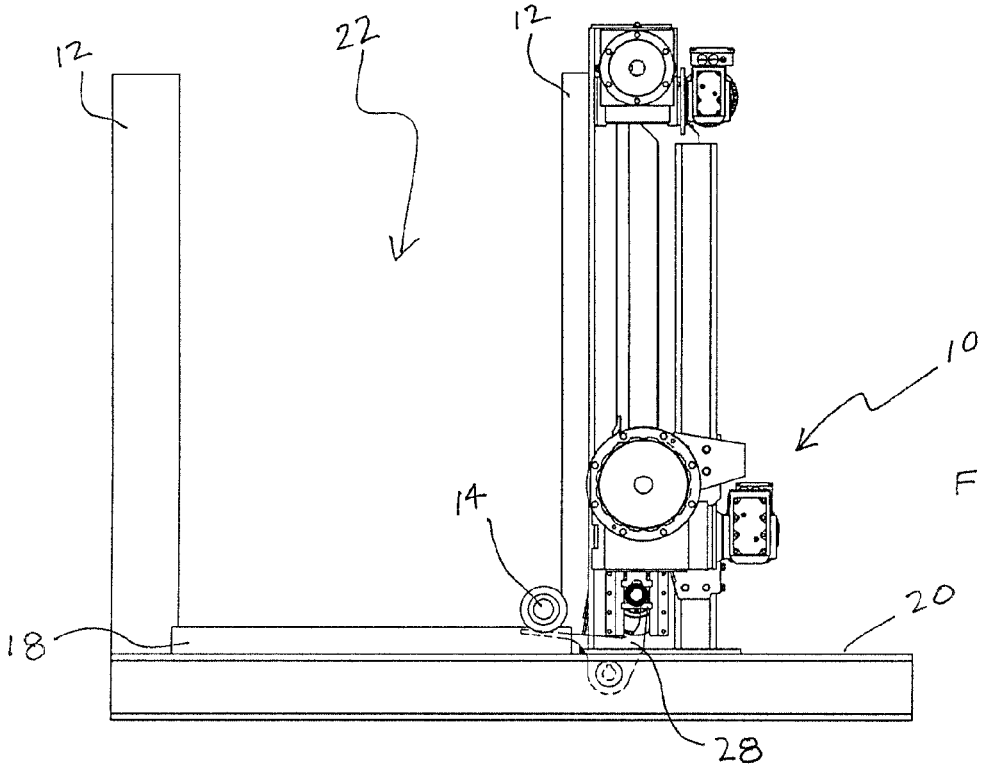
FIG. 6 is an end elevation view depicting the pipe-handling apparatus of FIG. 2 removing a section of pipe from the bottom tier on a pipe rack.

Referring to FIGS. 5 and 6, apparatus 10 is shown picking a pipe 14 from the top tier and bottom tier of pipe rack 22, respectively. In some embodiments, the ability of apparatus 10 to move up and down on guide beam 30, and to rotate arm 26 can allow apparatus 10 to pick a section of pipe from any tier in pipe rack 22.

Figure 7:
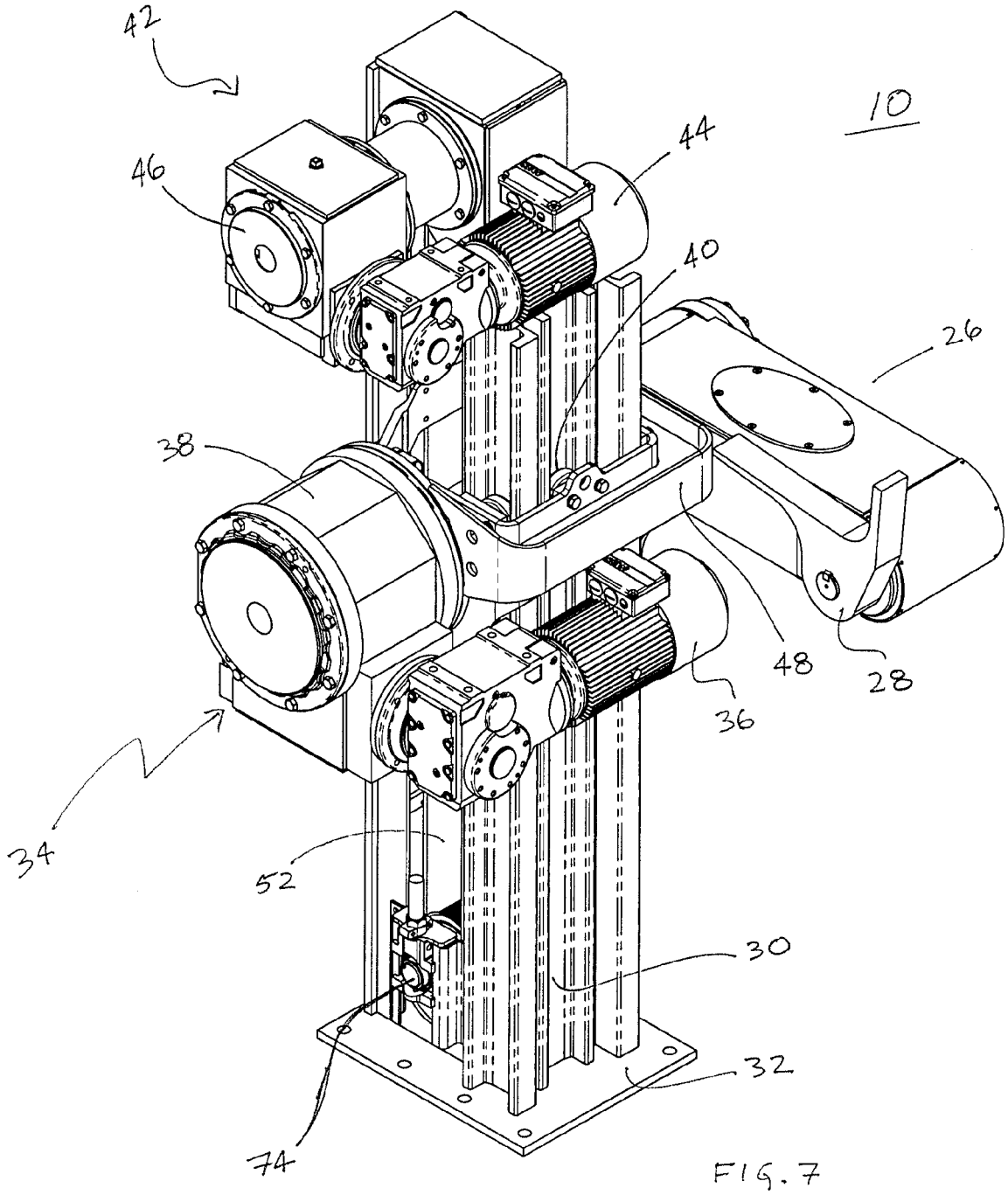
FIG. 7 is a front perspective view depicting the pipe-handling apparatus shown in FIG. 1.
Figure 8:
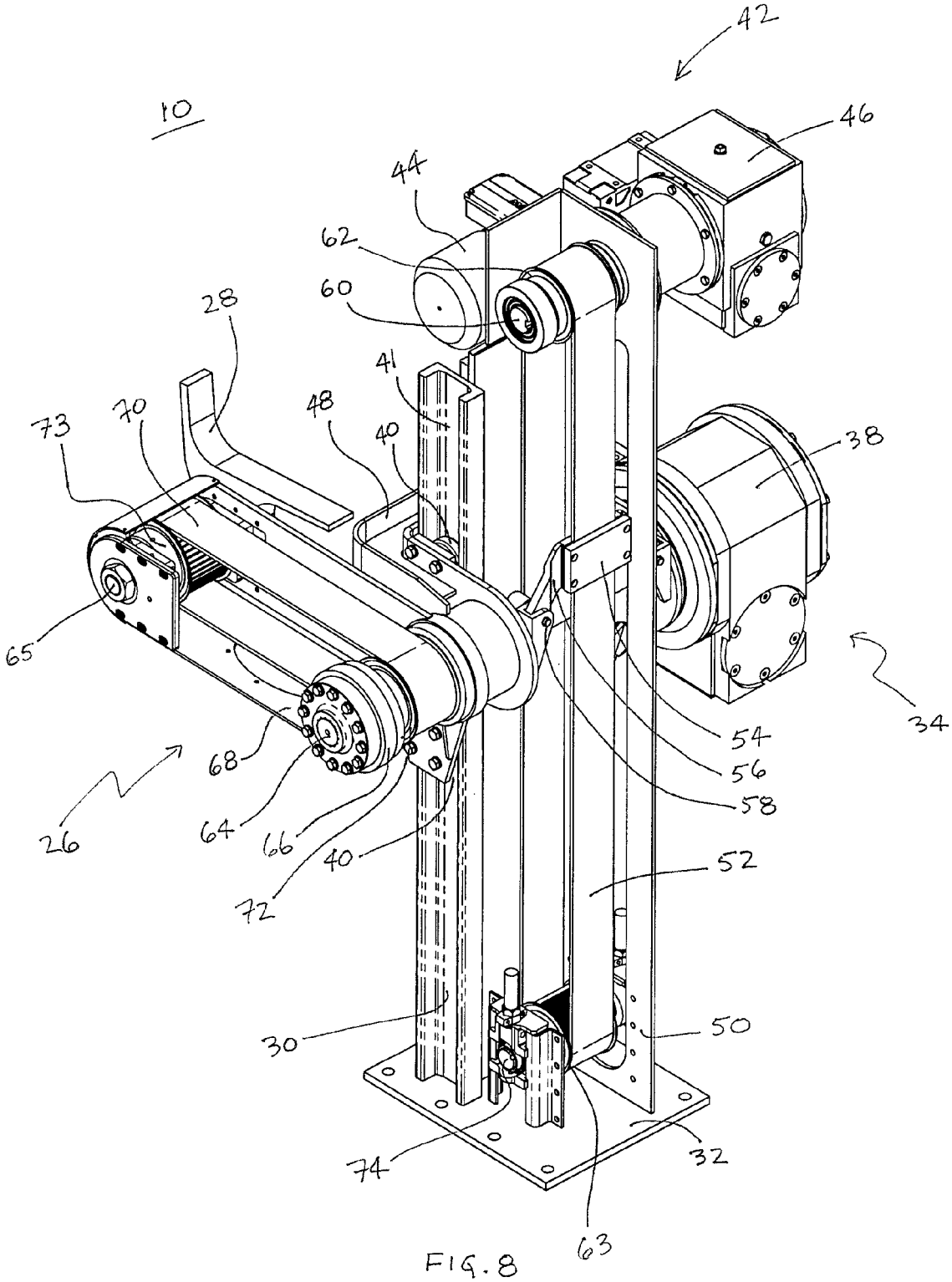
FIG. 8 is a rear perspective view depicting the pipe-handling apparatus of FIG. 7.
Figure 9:
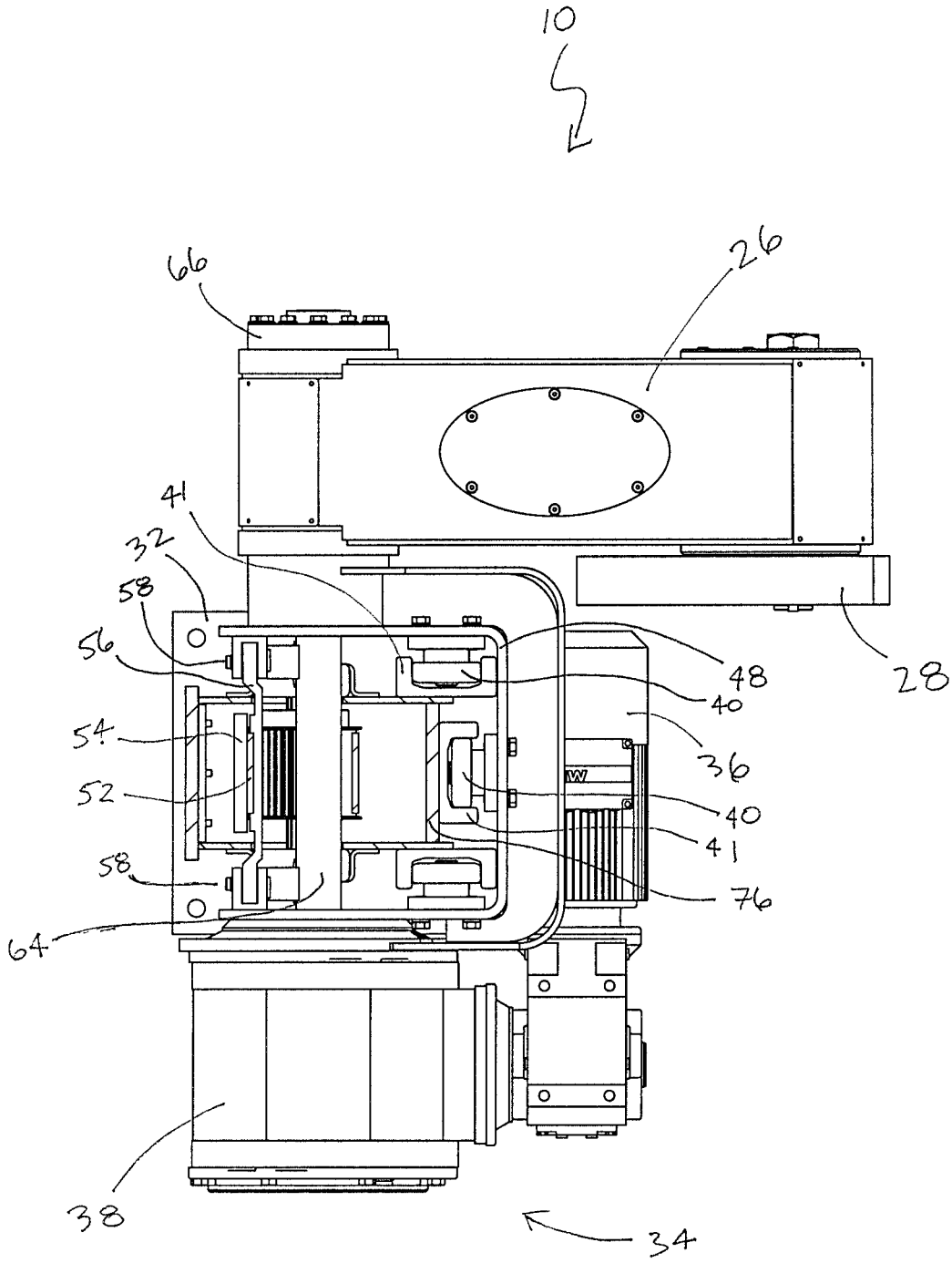
FIG. 9 is a top plan view depicting the pipe-handling apparatus of FIG. 7.

Referring to FIGS. 7, 8 and 9, one embodiment of apparatus 10 is illustrated. In some embodiments, apparatus 10 can comprise a substantially vertical guide beam 30 disposed on base plate 32. This configuration can permit apparatus 10 to be affixed to the deck floor of a drilling rig adjacent to a Samson post or to a pipe-handling device that can skid across the deck floor. In some embodiments, apparatus 10 can comprise lift drive assembly 42, that can further comprise lift drive gear motor 44 operatively coupled to lift drive reducer 46. Lift drive assembly 42 can be disposed on the upper end of frame member 50 that can also be disposed on base plate 32, adjacent to guide beam 30. Lift drive assembly 42 can further comprise shaft 60 operatively coupled to lift drive reducer 46 to provide motive power to a continuous loop drive mechanism comprising of a belt and pulleys. Pulley 62 can be disposed on shaft 60 to turn belt 52. At a lower end of apparatus 10, belt 52 can rotate around pulley 63, which can freewheel on belt tensioner 74 operatively coupled to apparatus 10 to maintain tension in belt 52.

In some embodiments, apparatus 10 can further comprise arm drive assembly 34 that can be configured to move up and down guide beam 30. Arm drive assembly 34 can comprise carriage 48 disposed around guide beam 30. Carriage lift bar 56 can be operatively attached to belt 52 with means for attaching carriage lift bar 56 thereto. In the illustrated embodiment, the attaching means can comprise clamp plate 54 clamped to belt 52, wherein carriage lift bar 56 is operatively attached to carriage 48 with pins 58. Once carriage lift bar 56 is clamped to belt 52 with clamp plate 54, carriage 48 can move up or down guide beam 30, guided by rollers 40 travelling within guide channels 41, as lift drive assembly 42 operates. It is obvious to those skilled in the art that if belt 52 is replaced with a chain, for example, the attaching means can comprise one or more pins, or other functionally equivalent means, to attach lift bar 56 to the chain.

In some embodiments, arm drive assembly 34 can comprise arm drive motor 36 operatively coupled to arm drive reducer 38 that, in turn, can rotate shaft 64 operatively coupled to torque coupler 66 and pulley 72. Arm 26 can comprise arm housing 68 that encloses tine shaft 65 and pulley 73 affixed to tine shaft 65. Tine 28 can be operatively coupled to tine shaft 65. Belt 70 can wrap around pulleys 72 and 73 inside of arm housing 68. As shaft 64 turns, the rotational torque can be applied to arm housing 68 via torque coupler 66 whereby arm 26 can rotate clockwise or counter clockwise depending on the direction of the rotation of shaft 64. As arm 26 rotates, the physical relationship of belt 70 and pulleys 72 and 73 to operate as a synchronizing loop mechanism and cause tine shaft 65 to rotate as arm 26 rotates. Pulley 72 can be configured to remain stationary as arm 26 rotates. This can cause belt 70 to rotate pulley 73 and tine shaft 65, wherein tine 28 can maintain a relatively fixed position relative to apparatus 10 as arm 26 rotates.

While the illustrated embodiment uses belts and pulleys, it is obvious to those skilled in the art that belts 52 and 70, and pulleys 62, 63, 72 and 73, can be replaced with functional equivalents. These equivalents can comprise chains and sprockets, cables and pulleys, intermeshing gears, rack and pinion gears or any combinations thereof. It is also obvious to those skilled in the art that motors 36 and 44 can be electric motors of any applicable variant, such as AC fixed frequency motors, AC variable frequency motors, DC motors, stepper motors or any other functionally equivalent motor including, but not limited to, hydraulic motors or pneumatic motors. In some embodiments, one or more of arm drive reducer 38 and lift drive reducer 46 can comprise a transmission to reduce or step down the rotation speed of motors 36 and 44, respectively. Reducers 38 and 46 can comprise worm gear mechanisms, planetary gear mechanisms, intermeshing gear mechanisms, ring and pinion gear mechanisms, any combinations thereof or any other functionally equivalent mechanisms as known to those skilled in the art.

In some embodiments, the control and operation of apparatus 10 can further comprise operational controls (not shown) that can permit the manual operation of one or more apparatuses 10 in tandem to move pipe 14 in and out pipe rack 22. If motors 36 and 44 comprise electric motors, then the controls can comprise an electrical control panel to control the operation of the motors as known to those skilled in the art. If motors 36 and 44 comprise hydraulic or pneumatic motors, then the controls can comprise hydraulic or pneumatic control systems as known to those skilled in the art. In some embodiments, apparatus 10 can further comprise at least one automated control mechanism (not shown), such as general purpose computers, programmable logic controllers, microprocessors, microcontrollers, hydraulic fluid control systems, pneumatic control systems or other functionally equivalents systems as known to those skilled in the art to monitor, control and operate one or more apparatuses 10, singly or in tandem, manually or as part of an automated system.

In some embodiments, apparatus 10 can comprise one or more position sensors operatively connected to a control system, as known to those skilled in the art (not shown), the sensors disposed on apparatus 10 to monitor the position and movement of arm 26 or carriage 48 for use in the control and operation of apparatus 10. Suitable examples can include rotary encoders disposed on shafts 60, 64 or 65 that can be monitored by a control system, or disposed within one or more of motors 36 and 44. Other examples can include one or more of electro-optical and magnetic components, as known to those skilled in the art, operatively connected to a control system.

Figure 10:
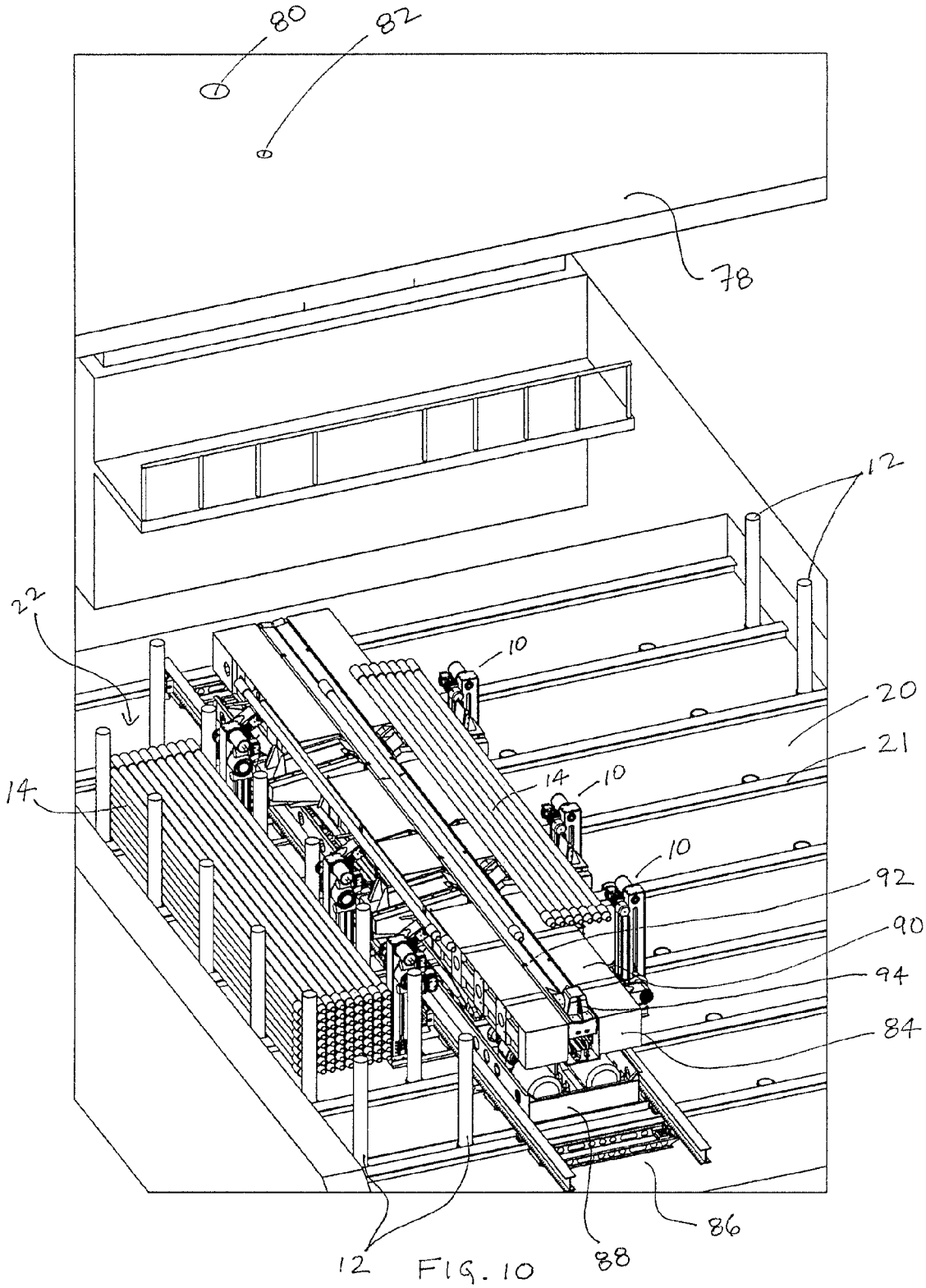
FIG. 10 is a perspective view depicting a pipe-handling device located on a Jack-up drilling rig adjacent to a pipe rack removing a section of pipe from the pipe rack using the pipe-handling apparatus of FIG. 7.
Figure 11:
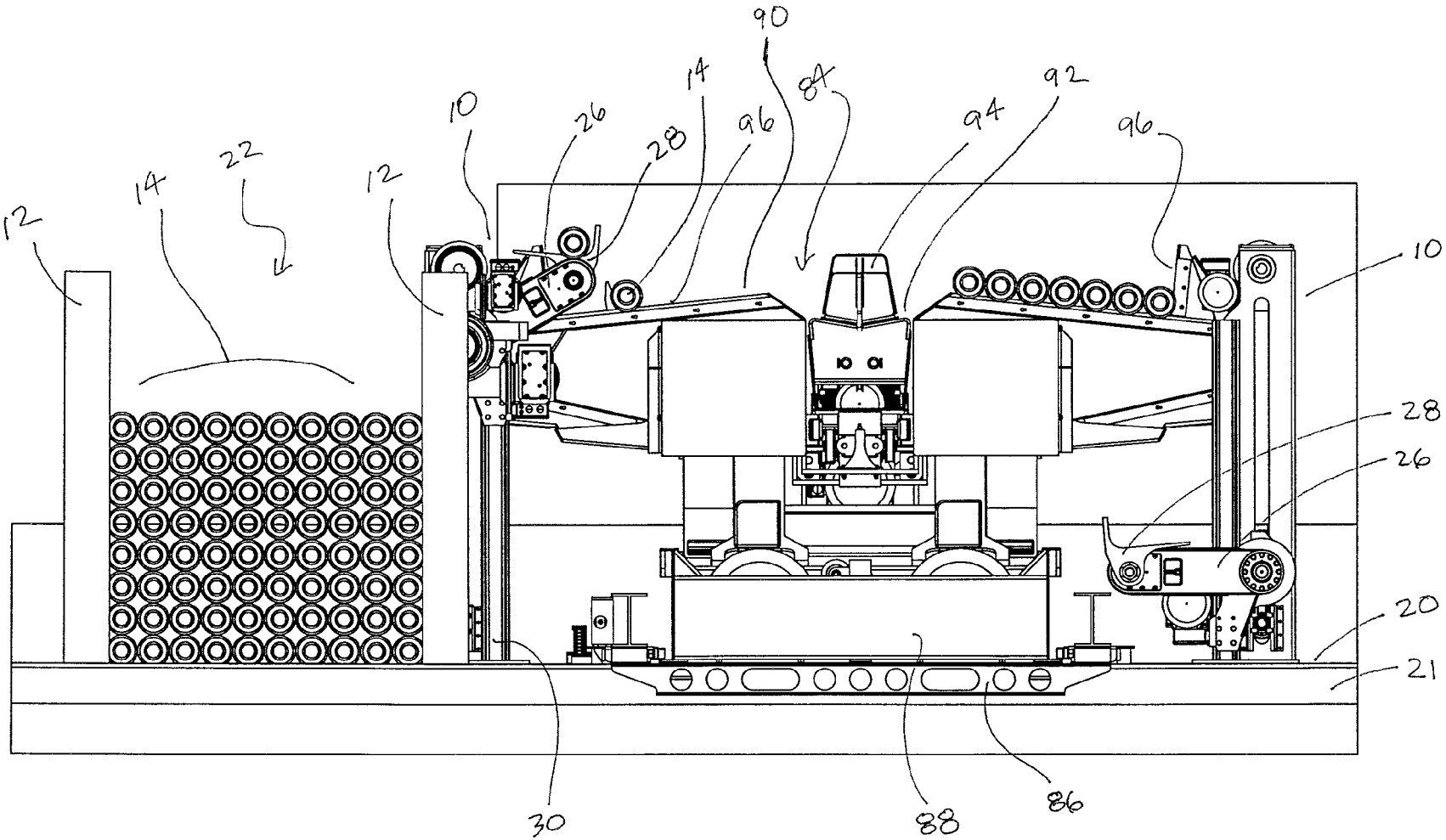
FIG. 11 is an end elevation view depicting the pipe-handling device of FIG. 10.
Figure 12:
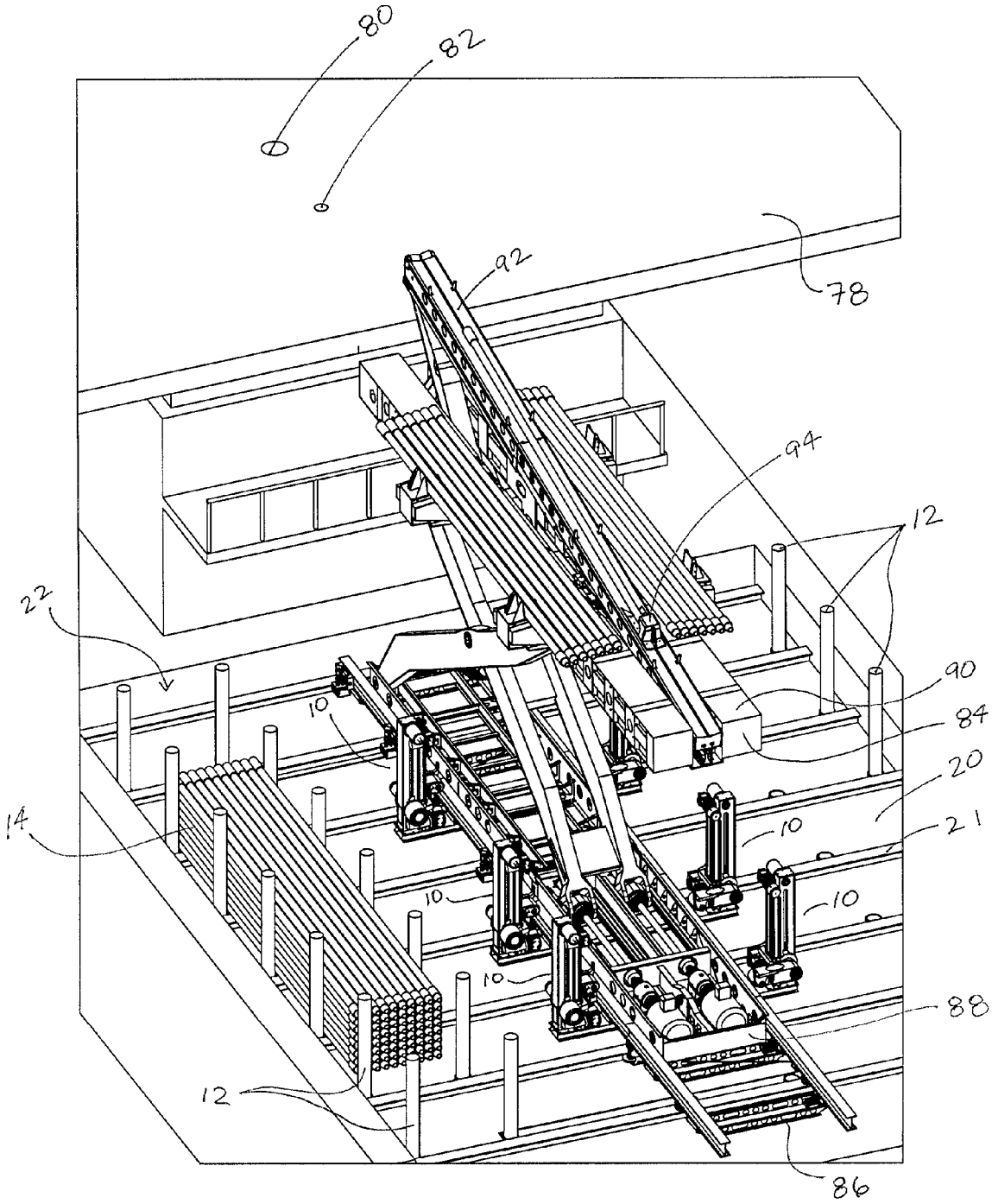
FIG. 12 is a perspective view depicting the pipe-handling device of FIG. 10 skidded over on the drilling rig to present the section of pipe to the drilling rig floor.

Referring to FIGS. 10, 11 and 12, one embodiment of apparatus 10 is shown as part of a larger system to move pipe 14 from pipe rack 22 to drilling rig floor 78 comprising well bore 80 and mouse hole 82. In this configuration, the system can comprise pipe handler 84 situated on deck beams 21 of pipe deck 20. Pipe handler 84 can comprise lower frame 88 having skidding system 86 engaging deck beams 21. A plurality of apparatuses 10 can be used to move pipe 14 from pipe rack 22 up and over Samson posts 12 onto kicker/indexer 96 disposed on pipe handler deck 90. It is obvious to those skilled in the art that at least two apparatuses 10 would be used on each side of pipe handler 84 in order to easily balance and carry a pipe although a single apparatus 10 could be used near the middle of pipe handler 84 and lift and balance a section of pipe provided that suitable changes are made to tine 28 to enable it to carry a pipe, such as increasing the width of tine 28 and including an upper portion or jaw that can clamp the pipe once resting on tine 28.

Once a plurality of pipes 14 is positioned on kicker/indexer 96 by apparatus 10, pipe handler 84 can be skidded across pipe deck 20 to a predetermined position for presenting pipe 14 to drilling rig floor 78, as shown in FIG. 12. In some embodiments, pipe handler 84 can be carried on skidding system 86 that can move under power in the fore and aft directions as well as side to side so as to position pipe handler 84 relative to Samson posts 12, as well as move to a position in line with well bore 80 for delivering pipe 14 between pipe handler deck 90 and drilling rig floor 78 without the use of a crane.

Once pipe handler 84 is in position, pipe handler deck 90 can be elevated to a starting position. Pipe 14 can then be placed in trough 92 by kicker/indexer 96 so that trough 92 can be further raised and elevated so as to present pipe 14 to drilling rig floor 78. Skate 94 can be used to push pipe 14 up along trough 92 towards drilling rig floor 78. When tripping pipe 14 out of well bore 80, the above mentioned procedure can be reversed to remove pipe 14 from drilling rig floor 78 to be returned to pipe rack 22. In this illustrated embodiment, apparatuses 10 can be operatively disposed on pipe handler 84.

In other embodiments, such as one illustrated in FIGS. 13 to 16, the Samson post elevator, shown as apparatus 100 in these figures, can be operatively disposed on Samson posts 12. In some embodiments, Samson posts 12 can comprise I-beams or boxed beams whereby apparatus 100 can be configured to move up and down these types of beams.

Figure 13:
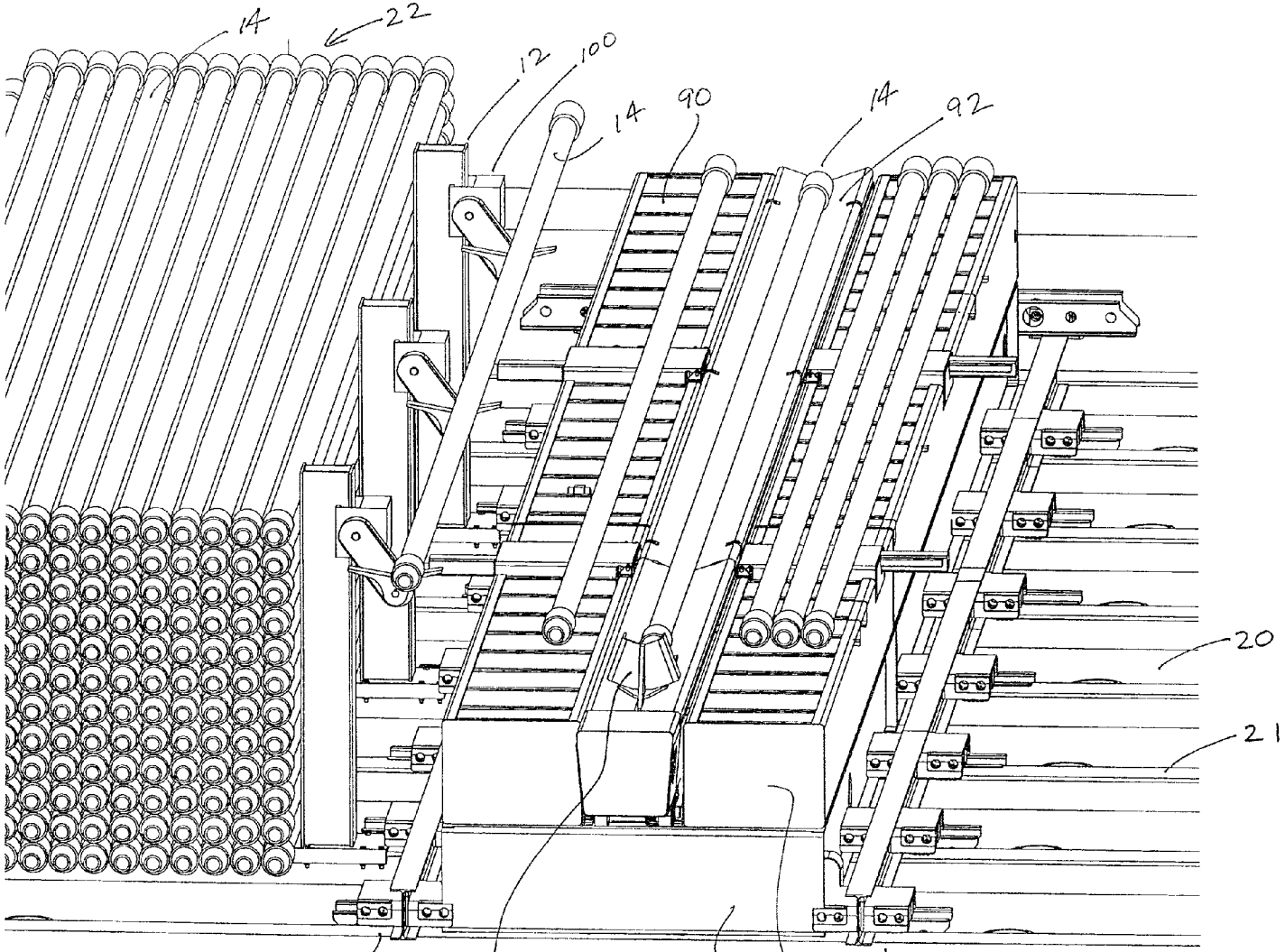
FIG. 13 is a close-up perspective view depicting an alternate embodiment of the pipe-handling apparatus as shown in FIG. 1 moving a section of pipe from a pipe rack onto a pipe-handling device.
Figure 14:
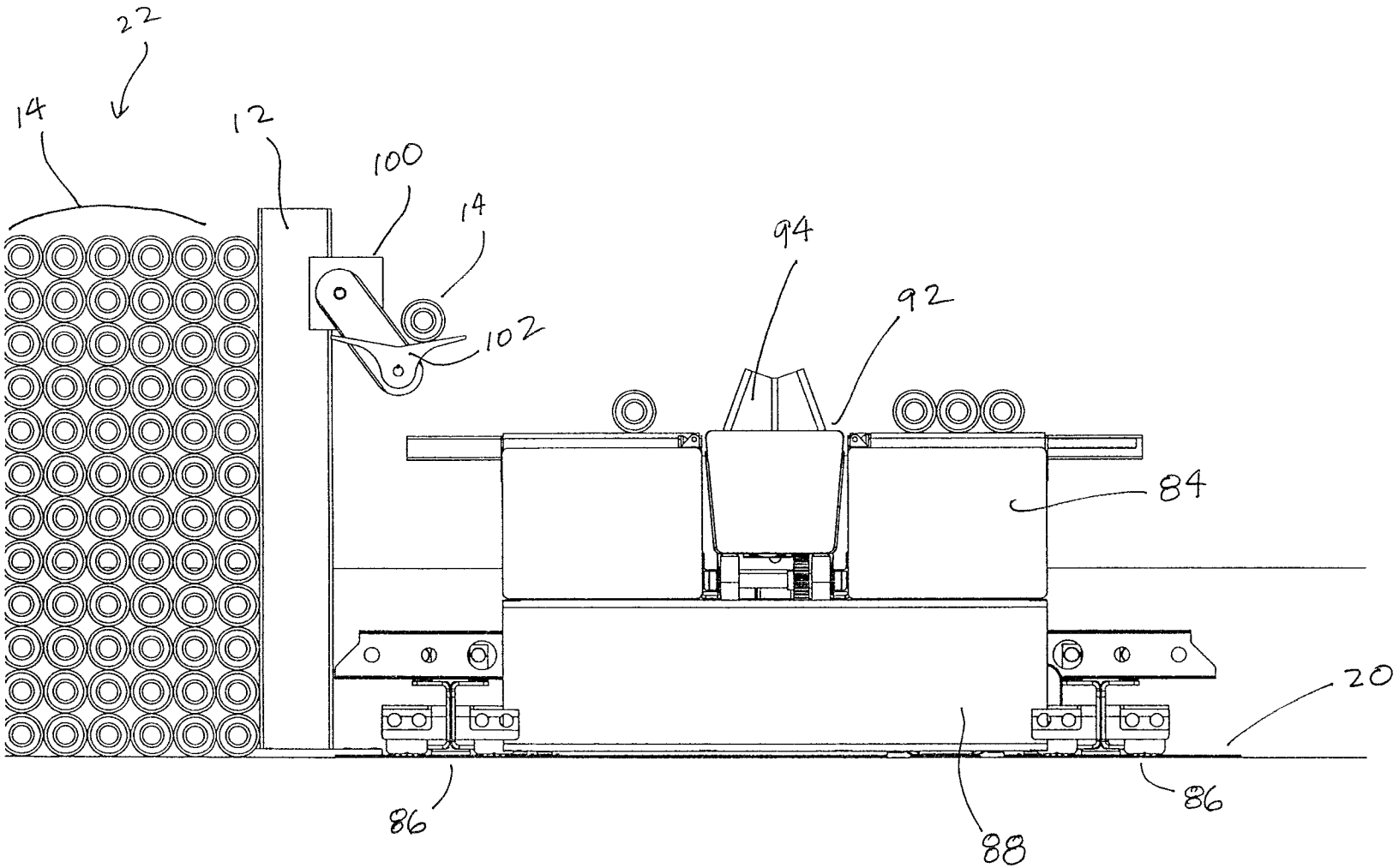
FIG. 14 is an end elevation view depicting the pipe-handling apparatus of FIG. 13.
Figure 15:
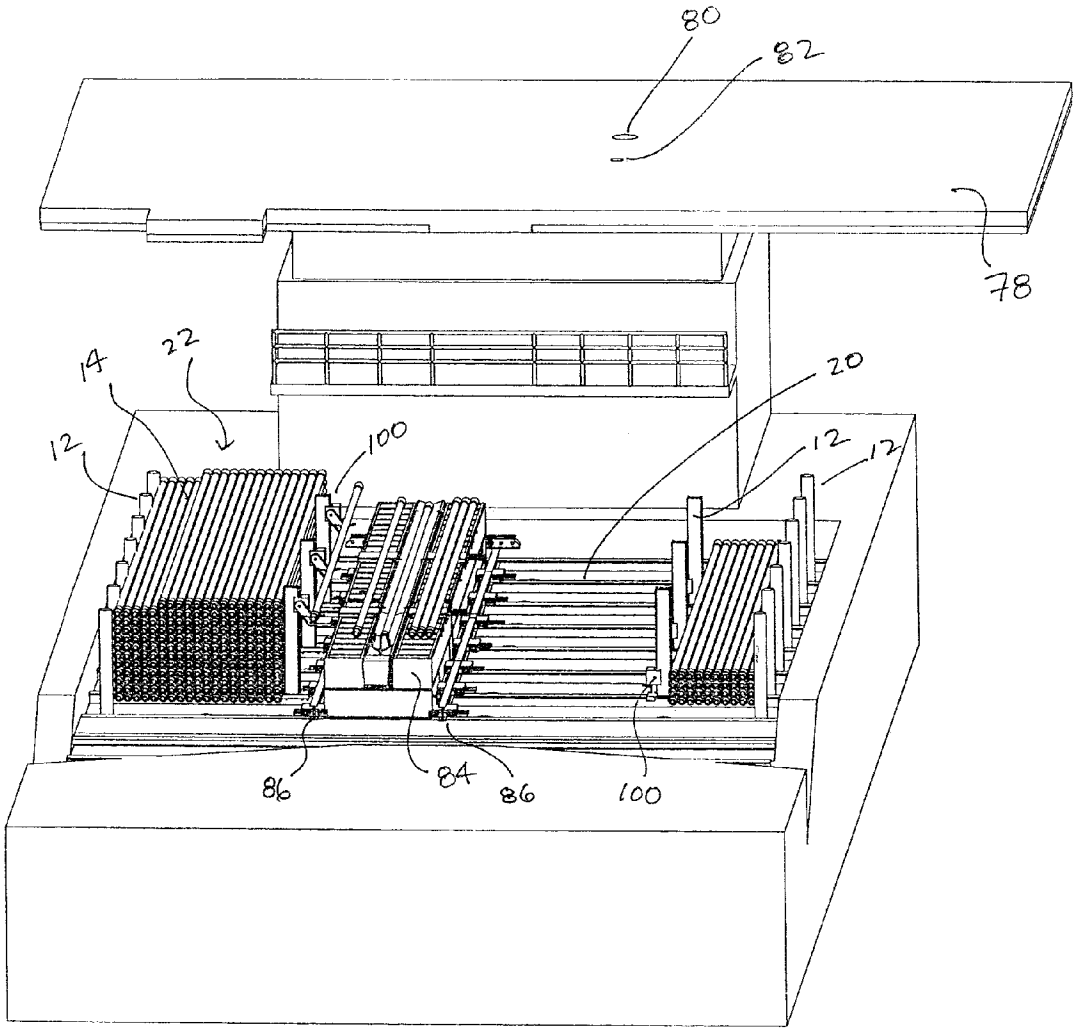
FIG. 15 is a wide-angle perspective view depicting the pipe-handling apparatus of FIG. 13 shown on the left-hand side of the pipe deck of a drilling rig.
Figure 16:
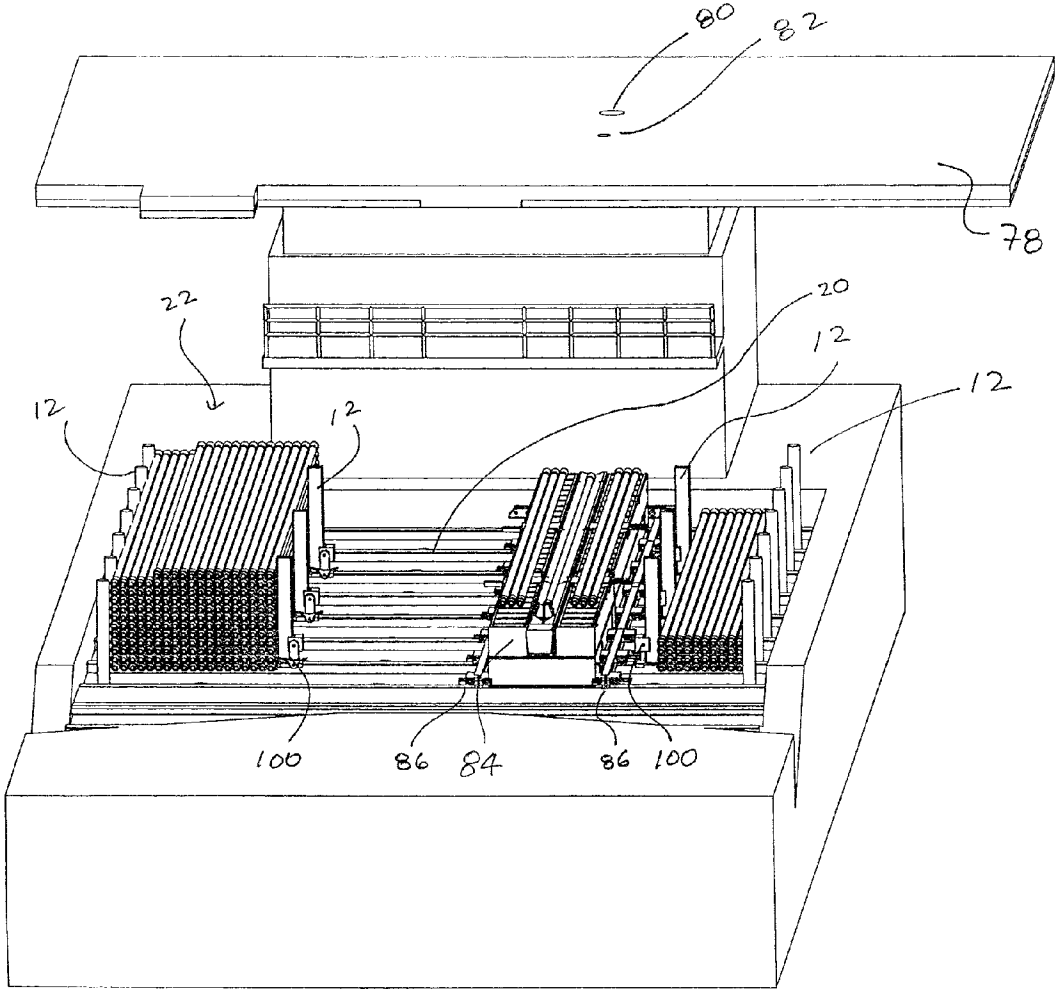
FIG. 16 is a wide-angle perspective view depicting the pipe-handling apparatus of FIG. 15 shown skidded over to the right-hand side of the pipe deck of the drilling rig.

Referring to FIGS. 13, 14 and 15, pipe handler 84 is shown positioned beside pipe rack 22. Apparatuses 100 disposed on Samson posts 12 can move pipe 14 from pipe rack 22 to pipe handler deck 90. Once loaded with pipe 14, pipe handler 84 can skid along pipe deck 20 by skidding system 86 to align with well bore 80 on drilling rig floor 78, as shown in FIG. 16.

Although a few embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

I claim:

1. An apparatus for raising pipe from a pipe rack up and over a Samson post to a pipe handler located on a pipe deck of a drilling rig, the apparatus comprising:

a) a substantially vertical beam configured to be positioned adjacent the Samson post on the pipe deck;

b) a carriage disposed on the vertical beam, the carriage configured to move up and down the vertical beam;

c) a lift drive assembly configured to move the carriage up and down the vertical beam, wherein the lift drive assembly comprises a continuous loop drive mechanism, the lift drive assembly further comprising a first motor configured to operate the continuous loop drive mechanism;

d) an arm rotatably disposed on the carriage, the arm further comprising a tine configured to pick up and carry pipe; and e) an arm drive assembly configured to rotate the arm, the arm drive assembly further comprising:

i) a second motor comprising a second drive shaft for rotating the arm, ii) a housing comprising first and second ends, the first end operatively coupled to the second drive shaft, ii) a tine shaft rotatably disposed in the second end of the housing, the tine operatively coupled to the tine shaft, and iv) a synchronizing loop mechanism operatively coupling the tine shaft to the second drive shaft wherein the tine remains in a fixed position relative to the apparatus as the arm rotates.

2. The apparatus as set forth in claim 1, wherein the carriage is slidably disposed on the vertical beam.

3. The apparatus as set forth in claim 2, wherein the carriage further comprises rollers configured to travel in roller guide channels disposed on the vertical beam.

4. The apparatus as set forth in claim 1, wherein the continuous loop drive mechanism comprises one or more of the group consisting of belts and pulleys, chains and sprockets, cables and pulleys, rack and pinion gears, and intermeshing gears.

5. The apparatus as set forth in claim 1, further comprising a tensioner for tensioning the continuous loop drive mechanism.

6. The apparatus as set forth in claim 1, wherein the carriage further comprises means for attaching the carriage to the continuous loop drive mechanism.

7. The apparatus as set forth in claim 1, wherein the first motor further comprises a first drive shaft for driving the continuous loop drive mechanism.

8. The apparatus as set forth in claim 7, wherein the first motor comprises one or more of the group consisting of AC fixed frequency electric motors, AC variable frequency electric motors, DC motors, stepper motors, hydraulic motors and pneumatic motors.

9. The apparatus as set forth in claim 7, further comprising a first transmission for reducing the rotational shaft speed of the first drive shaft, the first transmission operatively coupling the first motor to the continuous loop drive mechanism.

10. The apparatus as set forth in claim 1, wherein the second motor comprises one or more of the group consisting of AC fixed frequency electric motors, AC variable frequency electric motors, DC motors, stepper motors, hydraulic motors and pneumatic motors.

11. The apparatus as set forth in claim 1, further comprising a second transmission for reducing the rotational shaft speed of the second drive shaft, the second transmission operatively coupling the second motor to the arm.

12. The apparatus as set forth in claim 1, wherein the synchronizing loop mechanism comprises one or more from the group consisting of belts and pulleys, chains and sprockets, cables and pulleys, rack and pinion gears, and intermeshing gears.

13. A method for raising pipe from a pipe rack up and over a Samson post to a pipe handler on a pipe deck of a drilling rig, the method comprising the steps of:

a) providing an apparatus comprising:

i) a substantially vertical beam configured to be positioned adjacent the Samson post on the pipe deck, ii) a carriage disposed on the vertical beam, the carriage configured to move up and down the vertical beam, iii) a lift drive assembly configured to move the carriage up and down the vertical beam, wherein the lift drive assembly comprises a continuous loop drive mechanism, the lift drive assembly further comprising a first motor configured to operate the continuous loop drive mechanism, iv) an arm rotatably disposed on the carriage, the arm further comprising a tine configured to pick up and carry pipe, and v) an arm drive assembly configured to rotate the arm, the arm drive assembly further comprising:

a second motor comprising a second drive shaft for rotating the arm, a housing comprising first and second ends, the first end operatively coupled to the second drive shaft, a tine shaft rotatably disposed in the second end of the housing, the tine operatively coupled to the tine shaft, and a synchronizing loop mechanism operatively coupling the tine shaft to the second drive shaft wherein the tine remains in a fixed position relative to the apparatus as the arm rotates;

b) rotating the arm and moving the carriage on the vertical beam wherein the tine engages and lifts the pipe; and c) moving the carriage up on the vertical beam and rotating the arm wherein the pipe is carried over the top of the Samson post.

14. The method as set forth in claim 13, wherein the carriage is slidably disposed on the vertical beam.

15. The method as set forth in claim 14, wherein the carriage further comprises rollers configured to travel in roller guide channels disposed on the vertical beam.

16. The method as set forth in claim 13, wherein the continuous loop drive mechanism comprises one or more of the group consisting of belts and pulleys, chains and sprockets, cables and pulleys, rack and pinion gears, and intermeshing gears.

17. The method as set forth in claim 13, further comprising a tensioner for tensioning the continuous loop drive mechanism.

18. The method as set forth in claim 13, wherein the carriage further comprises means for attaching the carriage to the continuous loop drive mechanism.

19. The method as set forth in claim 13, wherein the first motor further comprises a first drive shaft for driving the continuous loop drive mechanism.

20. The method as set forth in claim 19, wherein the first motor comprises one or more of the group consisting of AC fixed frequency electric motors, AC variable frequency electric motors, DC motors, stepper motors, hydraulic motors and pneumatic motors.

21. The method as set forth in claim 19, further comprising a first transmission for reducing the rotational shaft speed of the first drive shaft, the first transmission operatively coupling the first motor to the continuous loop drive mechanism.

22. The method as set forth in claim 13, wherein the second motor comprises one or more of the group consisting of AC fixed frequency electric motors, AC variable frequency electric motors, DC motors, stepper motors, hydraulic motors and pneumatic motors.

23. The method as set forth in claim 13, further comprising a second transmission for reducing the rotational shaft speed of the second drive shaft, the second transmission operatively coupling the second motor to the arm.

24. The method as set forth in claim 13, wherein the synchronizing loop mechanism comprises one or more from the group consisting of belts and pulleys, chains and sprockets, cables and pulleys, rack and pinion gears, and intermeshing gears.

25. An improved pipe handler for use on a pipe deck on a drilling rig, the pipe handler configured for moving pipe from a pipe rack located behind Samson posts disposed on the pipe deck to a drilling rig floor, the improvement comprising at least one apparatus disposed on the pipe handler, the apparatus configured raising pipe from the pipe rack up and over the Samson posts to the pipe handler, the apparatus comprising:

a) a substantially vertical beam configured to be positioned adjacent one of the Samson posts on the pipe deck;

b) a carriage disposed on the vertical beam, the carriage configured to move up and down the vertical beam;

c) a lift drive assembly configured to move the carriage up and down the vertical beam, wherein the lift drive assembly comprises a continuous loop drive mechanism, the lift drive assembly further comprising a first motor configured to operate the continuous loop drive mechanism;

d) an arm rotatably disposed on the carriage, the arm further comprising a tine configured to pick up and carry pipe; and e) an arm drive assembly configured to rotate the arm, the arm drive assembly further comprising:

i) a second motor comprising a second drive shaft for rotating the arm, ii) a housing comprising first and second ends, the first end operatively coupled to the second drive shaft, iii) a tine shaft rotatably disposed in the second end of the housing, the tine operatively coupled to the tine shaft, and iv) a synchronizing loop mechanism operatively coupling the tine shaft to the second drive shaft wherein the tine remains in a fixed position relative to the apparatus as the arm rotates.

26. The pipe handler as set forth in claim 25, wherein the carriage is slidably disposed on the vertical beam.

27. The pipe handler as set forth in claim 26, wherein the carriage further comprises rollers configured to travel in roller guide channels disposed on the vertical beam.

28. The pipe handler as set forth in claim 25, wherein the continuous loop drive mechanism comprises one or more of the group consisting of belts and pulleys, chains and sprockets, cables and pulleys, rack and pinion gears, and intermeshing gears.

29. The pipe handler as set forth in claim 25, further comprising a tensioner for tensioning the continuous loop drive mechanism.

30. The pipe handler as set forth in claim 25, wherein the carriage further comprises means for attaching the carriage to the continuous loop drive mechanism.

31. The pipe handler as set forth in claim 25, wherein the first motor further comprises a first drive shaft for driving the continuous loop drive mechanism.

32. The pipe handler as set forth in claim 31, wherein the first motor comprises one or more of the group consisting of AC fixed frequency electric motors, AC variable frequency electric motors, DC motors, stepper motors, hydraulic motors and pneumatic motors.

33. The pipe handler as set forth in claim 31, further comprising a first transmission for reducing the rotational shaft speed of the first drive shaft, the first transmission operatively coupling the first motor to the continuous loop drive mechanism.

34. The pipe handler as set forth in claim 25, wherein the second motor comprises one or more of the group consisting of AC fixed frequency electric motors, AC variable frequency electric motors, DC motors, stepper motors, hydraulic motors and pneumatic motors.

35. The apparatus as set forth in claim 25, further comprising a second transmission for reducing the rotational shaft speed of the second drive shaft, the second transmission operatively coupling the second motor to the arm.

36. The pipe handler as set forth in claim 25, wherein the synchronizing loop mechanism comprises one or more from the group consisting of belts and pulleys, chains and sprockets, cables and pulleys, rack and pinion gears, and intermeshing gears.

* * * * *